US005340348A

United States Patent [19]

Schroeder

[11] Patent Number: 5,340,348

[45] Date of Patent: Aug. 23, 1994

[54] DOLL WITH PATCH AND COVER FOR RELEASABLY ENGAGING A REMOVABLE ITEM

[76] Inventor: Eric J. Schroeder, 415 W. Gilmore, Angola, Ind. 46703

[21] Appl. No.: 84,012

[22] Filed: Jun. 29, 1993

[51] Int. Cl.[5] ..... A63H 3/50; A63H 3/52; B65D 5/00; B65D 73/00

[52] U.S. Cl. ..... 446/73; 446/901; 446/97; 446/478; 446/488; 446/75; 273/DIG. 30; 229/103; 206/579

[58] Field of Search ..... 446/321, 369, 901, 72-75, 446/100, 98, 97, 478, 488, 327; 273/DIG. 30; 434/393, 396; 206/457, 579; 229/103

[56] References Cited

U.S. PATENT DOCUMENTS

| | | | |
|---|---|---|---|
| D. 244,560 | 5/1977 | Derrington . | |
| 2,134,971 | 11/1938 | Guyer . | |
| 2,872,753 | 2/1959 | Fenton . | |
| 3,032,345 | 5/1962 | Lemelson . | |
| 3,316,669 | 5/1967 | Nachbar . | |
| 3,368,811 | 2/1968 | Finney . | |
| 3,440,747 | 4/1969 | Oliver . | |
| 3,558,139 | 1/1971 | Brandell | 229/103 |
| 3,789,547 | 2/1974 | Chemarin . | |
| 4,208,832 | 6/1980 | Corriveau . | |
| 4,235,042 | 11/1980 | Hills | 446/327 |
| 4,373,292 | 2/1983 | Pelura | 446/268 |
| 4,483,441 | 11/1984 | Byer | 446/901 X |
| 4,607,674 | 8/1986 | Noble . | |
| 4,637,798 | 1/1987 | Maiden-Nesset | 446/98 X |
| 4,648,548 | 3/1987 | Shin . | |
| 4,671,574 | 6/1987 | Wilson-Diehl | 446/901 X |
| 4,729,751 | 3/1988 | Schiavo et al. . | |
| 4,762,494 | 8/1988 | Woods . | |
| 4,824,414 | 4/1989 | Goldblatt . | |
| 4,883,441 | 11/1989 | Byer . | |
| 4,883,443 | 11/1989 | Chase | 446/478 |
| 5,222,657 | 6/1993 | Holland | 229/103 |

*Primary Examiner*—Danton D. DeMille
*Attorney, Agent, or Firm*—Barnes & Thornburg

[57] ABSTRACT

A doll has a body and an item that is sized to be releasably attached to the body. The item includes an attachment portion that is releasably engaged by engaging structure on the body. Covering structure is utilized to cover the engaging structure when the item is not attached to it. The engaging structure may include hook material and both the attachment structure and covering structure may include loop material. The doll may be outfitted with a uniform corresponding to a particular sport. The item may be a piece of sporting equipment proportionally sized relative to the doll and corresponding to the sport of the uniform. A kit may be provided for creating a sporting environment. The kit has an embodiment of the above-described doll, at least one item of sporting equipment proportionately sized relative to the doll, and a box for containing the doll and the sporting equipment. A uniform for the doll may also be included with the kit. The above-described attaching structure is on the sporting equipment. Adapting structure such as a perforated pattern on at least one surface of the box is used to create the sporting environment for interacting with the doll and sporting equipment.

25 Claims, 1 Drawing Sheet

DOLL WITH PATCH AND COVER FOR RELEASABLY ENGAGING A REMOVABLE ITEM

BACKGROUND AND SUMMARY OF THE INVENTION

The present invention relates to dolls and particularly to a three-dimensional action character. More particularly, the present invention relates to dolls that are configured to releasably engage sport-related equipment and packaging for the doll and equipment.

It is known to attach Velcro® or other equivalent hook and loop material to a doll to facilitate attachment of various items to the doll. The hook portion can be located on the doll and the loop portion located on the item to be attached to the doll. See, for example, U.S. Pat. No. 4,824,414 to Goldblatt.

At least one disadvantage associated with the use of Velcro® or hook and loop material is that the hook portion is uncovered when it is separated from the loop portion. The hook portion has a somewhat abrasive texture and contact of such things as skin and eyes with this hooked exposed surface is unwise. Another disadvantage is that debris attracted by an exposed hook portion can collect thereon and inhibit the operation of the hook portion.

Containers that can be partially or completely modified into another structure are known. See, for example, U.S. Pat. No. 2,134,971 to Guyer. These containers are environmentally beneficial in that they can be used for other purposes after containing an item rather than merely being thrown away. At least one disadvantage associated with some of these containers is that items separate from those contained therein are necessary for interaction with the container.

Applicant makes no representation by this discussion, nor should any such representation be inferred, that an exhaustive search of all relevant prior art has been conducted, or that no more pertinent prior art exists.

A doll with engaging structure (such as hook material) that can be covered when not in use so as to avoid the above-described problems would be a welcome improvement. In addition, a container that can be used to create an environment for interacting with the doll as well as to transport and protect the doll would also be a welcome improvement.

In accordance with the present invention, an apparatus includes a doll having a body, a head connected to the body, and a pair of arms and legs connected to the body. The body, head, arms, and legs are in the general configuration of a human figure. The head, arms and legs may be movable or fixed. At least one engaging structure is appended to the doll and configured to permit an item to be releasably attached to the doll by engaging attachment structure on the item. A cover is provided and arranged to cover the engaging structure when no item is attached to the engaging structure. The engaging structure and cover may occupy a plurality of positions on the body. In preferred embodiments, the engaging structure includes hook material and both the attachment structure and cover include loop material.

Illustratively, the doll is outfitted with a uniform so as to resemble a player of a particular sport. In addition, each item that is to be attached to the engaging structure on the doll is a piece of sporting equipment proportionately sized relative to the doll and corresponding to the sport represented by the uniform.

In one embodiment, the engaging structure is on a front surface of a strip. The cover is also on the front surface of the strip. The strip is connected to the doll so that the cover is movable to cover and disable the engaging structure and expose a portion of the back surface. The exposed portion of the back surface has a smooth texture.

A box for transporting the doll and collateral items has four sides, a top, and a bottom, all of which are connected together so as to define a container for holding the doll. Structure for adapting the box so as to create an environment for interacting with the doll and item is also provided. The adapting structure may include a perforated pattern on at least one surface of the box.

Illustratively, the doll and box may form a kit that can be assembled by a user to create a sporting environment. The kit comprises the above-described doll. At least one piece of sporting equipment proportionately sized relative to the doll is included in the kit. Engaging structure is on the doll for releasably attaching the sporting equipment to the doll. The sporting equipment has structure thereon for attaching to the engaging structure on the doll. A cover is provided and arranged to cover the engaging structure when no item of sporting equipment is attached to the doll.

The kit may be assembled, for example, by a child. The doll and sporting equipment could be removed from the box by the child. The child could then adapt the box to create a sporting environment for interacting with the doll. Illustratively, a doll may come with a baseball uniform and baseball bat. These items could be removed from a box. A perforated pattern on a side of the box would allow bases to be removed from the side of the box. The child could place the bases on a playing field defined by another portion of the box. The bat could be releasably attached to the hands of the doll via the above-described attaching and engaging structure so that the doll could interact with the baseball playing field. When the bat was not in the hands of the doll, the cover could overlie the engaging structure.

Other objects, advantages and novel features of the present invention will become apparent from the following detailed description of the invention when considered in conjunction with the accompanying drawings.

DETAILED DESCRIPTION OF THE DRAWINGS

Figure 1:
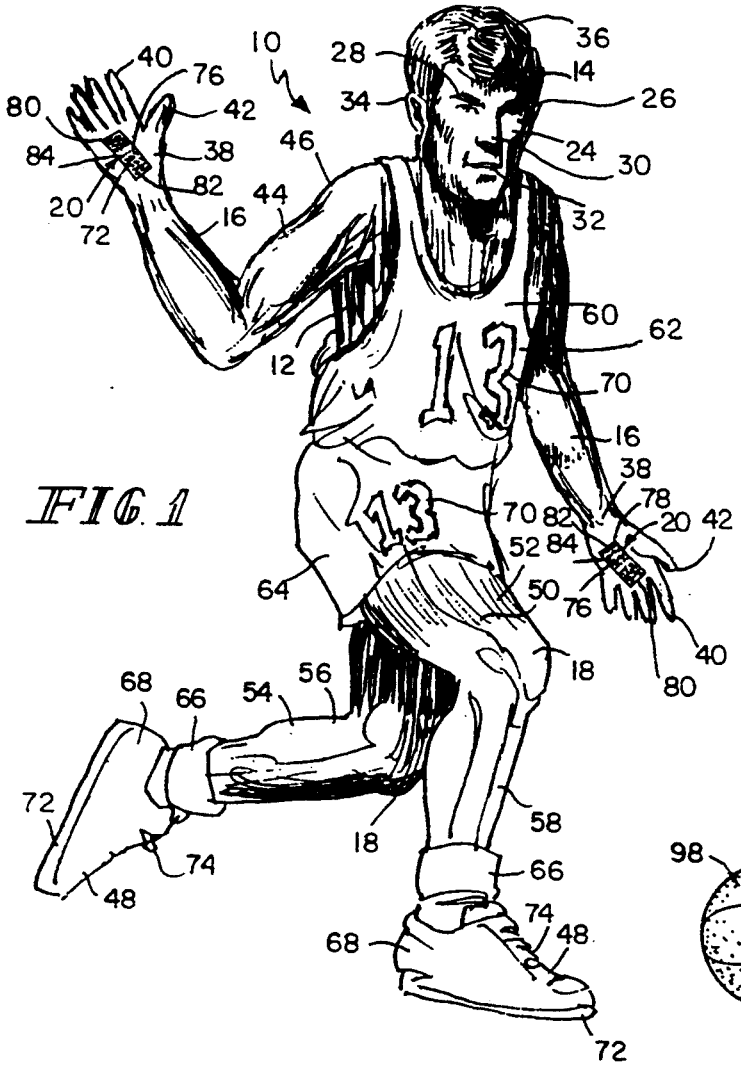
FIG. 1 is a perspective view of a sports doll in accordance with the present invention.

A doll 10 having a body 12, a head 14 connected to body 12, a pair of arms 16 and legs 18 also connected to body 12 is shown in FIG. 1. Engaging structure 20 is connected to doll 10 for releasably attaching item 22 (see FIGS. 3 and 4) so that item 22 can be attached to or removed from the doll 10 easily. Body 12, head 14, arms 16, and legs 18 are in the general configuration of a human figure. Although doll 10 is shown in FIG. 1 as a male, it is to be understood that doll 10 may also be female.

Head 14 has a face 24 with a pair of eyes 26, a pair of eyebrows 28, a nose 30, and a mouth 32. In addition, head 14 has a pair of ears 34 and hair 36 attached to it. In a preferred embodiment, head 14 is fixedly attached to body 12 (e.g., by sewing). However, head 14 may also be movably attached to body 12. Face 24, ears 34, and hair 36 of doll 10 may be formed so as to simulate a player of any race. In addition, the skin tone of doll 10 may be colored so as to simulate a player of any race.

Arms 16 each have hands 38 attached to them. As can be seen, hands 38 are in a human configuration, having four fingers 40 and a thumb 42. Hands 38 of a preferred embodiment are fixed but may also be movable in other embodiments. Arms 16 may simulate muscular features. For example, as shown in FIG. 1, each arm 16 has bicep 44 and deltoid 46 muscles. In a preferred embodiment, arms 16 are movable. However, arms 16 may also be fixed.

Legs 18 each have feet 48 attached to them. Feet 48 are in a human configuration and may have toes attached to them. Feet 48 of a preferred embodiment are fixed but may be movable in other embodiments. As with arms 16, legs 18 may simulate muscular features. For example, quadriceps muscle 50 is shown in thigh area 52 of leg 18. In addition, a calf muscle 54 can be seen on the lower portion 56 of leg 18. In a preferred embodiment, legs 18 are movable. However, legs 18 may also be fixed.

Doll 10 may be injection molded and has a wire frame 58 on the interior thereof. Wire frame 58 adds structural strength and form to the appendages of doll 10.

Doll 10 has a uniform or outfit 60. The embodiment of doll 10 shown in FIG. 1 is dressed so as to correspond to the sport of basketball. Accordingly, uniform 60 of doll 10 includes a "tank top" jersey 62, shorts 64, socks 66, and shoes or sneakers 68. As can be seen, both jersey 62 and shorts 64 have a team number 70. Jersey 62, shorts 64, and socks 66 may be made from cloth or equivalent material. Shoes 68 may be made from cloth, leather, plastic, or other equivalent material. In addition, shoes 68 may have a sole 72 with tread as well as laces 74. Although shown as "low-tops," shoes 68 may also be of the "high-top" variety. Uniform 60 may be either fixedly attached to doll 10 or loosely fitted and removable from the doll. In addition, uniform 60 may have a team logo, design or other identifying designation, such as color. Furthermore, although uniform 60 is shown as corresponding to the sport of basketball, it is to be understood that uniforms for other sports such as baseball, football, golf, hockey, tennis, soccer, and boxing are within the scope and spirit of the present invention. For example, a baseball sports doll could have cleats, a cap, a jersey, stirrup pants, and socks. A soccer sports doll could be outfitted with cleats, shin guards, a jersey, shorts, and socks.

Engaging structure 20 is illustratively shown on each of palms 76 of hands 38. In a preferred embodiment, engaging structure 20 consists of hook material 78. Hook material 78 of engaging structure 20 is intended to engage loop material 80 on at least a portion of item 22 (see FIGS. 3 and 4). Although only shown on palms 76 of hands 38, engaging structure 20 may be placed on other portions of doll 10 such as feet 48. In addition, engaging structure 20 may be placed on more than one location of doll 10 such as hands 38 and feet 48.

Figure 2:
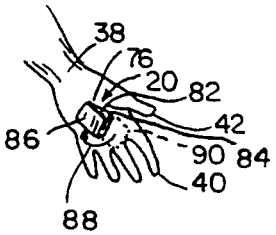
FIG. 2 is a view of one embodiment of the engaging and covering structure for use with the sports doll of FIG. 1.

FIGS. 1 and 2 show an embodiment of doll 10 where engaging structure 20 is on a front surface of a first portion 82 of a strip 84. In this embodiment, the back surface of the first portion 82 of strip 84 is connected to palm 76. Engaging structure 20 consists of hook material 78. Contact of such things as skin and eyes with this hooked surface is unwise. In addition, such an abrasive texture may tend to attract and collect debris over time when not in use (i.e., when not attached to item 22) and thus lose its adhesive qualities. To alleviate these and other problems, a covering structure 86 is provided for covering engaging structure 20 when not attached to an item 22. Covering structure 86 and engaging structure 20 are both on the front surface of strip 84. In this embodiment, covering structure 86 has loop material 80 (see FIG. 1) on it. First portion 82 of strip 84 is connected to palm 76 of hand 38 such that covering structure 86 can be moved in the direction of arrow 88 (see FIG. 2) to cover engaging structure 20. That is, covering structure 86 is moved in the general direction of arrow 88 so as to disable and cover engaging structure 20. When it is desired to engage an item 22, covering structure 86 is moved in a direction generally opposite that of arrow 88 so as to assume position 90 shown in outline (see FIG. 2) and expose hook material 78 of engaging structure 20.

Figure 3:
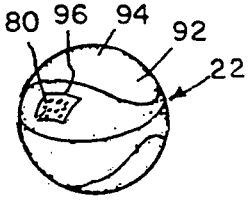
FIG. 3 is a view of one embodiment of the attaching structure for use with the sports doll of FIG. 1.

Referring to FIG. 3, item 22 is shown as a piece of sporting equipment 92 proportionally sized relative to doll 10. Sporting equipment 92 is used to interact with doll 10. As can be seen, sporting equipment 92 is in the general configuration of a basketball 94 so as to correspond with uniform 60 of doll 10. It should be noted, however, that other types of sporting equipment 92 are within the scope and spirit of the present invention. That is, sporting equipment 92 could include such things as a baseball, bat, and glove for interacting with a baseball sports doll or football and tee for interacting with a football sports doll. In the embodiment of FIG. 3, sporting equipment 92 has loop material 80 on a patch 96 for attaching with the hook material 78 on engaging structure 20. For the embodiment shown in FIGS. 1–3, this would allow basketball 94 to be releasably attached to palms 76 of hands 38. Other sporting equipment 92, for example, a bat, could have loop material 80 on a portion of the handle thereof so that the bat could be grasped between palms 76 of hands 38.

Figure 4:
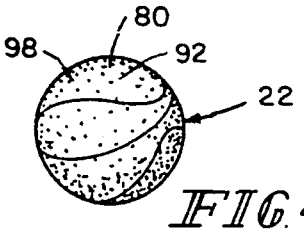
FIG. 4 is a view of another embodiment of the attaching structure for use with the sports doll of FIG. 1.

FIG. 4 illustrates an alternative embodiment, for placement of loop material 80 on item 22. In FIG. 4, loop material 80 is shown as being on the entire surface 98 of basketball 94. This allows basketball 94 to releasably attach to engaging structure 20 at any orientation.

Figure 5:
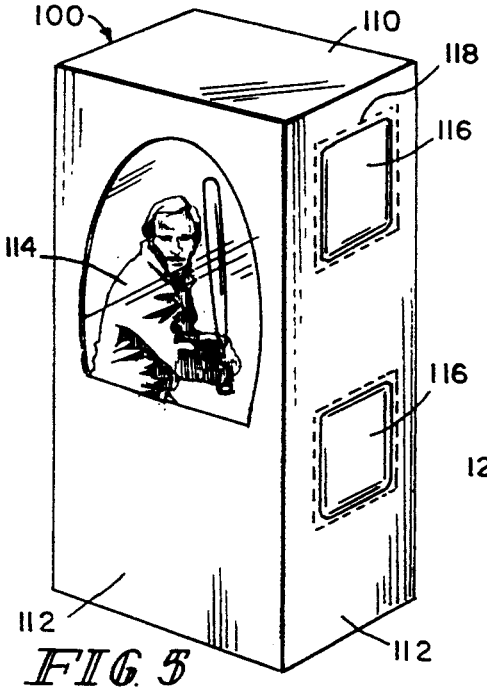
FIG. 5 is a perspective view of an embodiment of a box for containing and interacting with the sports doll of FIG. 1.

An embodiment of a box or container 100 for containing and interacting with doll 10 and sporting equipment 92 is shown in FIG. 5. Box 100 has a top 110, four sides 112 and a bottom (not shown). Box 100 may be constructed from cardboard, paper, plastic or other equivalent material. Box 100 houses doll 10 during transport and storage. Uniform 60 and sporting equipment 92 may also be contained in box 100 but not necessarily so. A drawing, sketch, or print 114, in line, black and white, or color, appears on front side 112 of box 100. Drawing 114 is intended to correspond to and indicate the sporting motif of doll 10, in this case baseball.

Box 100 may be adapted so as to create a playing environment for interacting with doll 10 and sporting equipment 92. Bases 116 are shown on side 112 of box 100 and may be removed so as to create a playing field for doll 10. Adapting structure such as perforations 118 may be provided to aid in the removal of bases 116 from side 112 of box 100. The adaptability of box 100 is also environmentally conscious in that material is utilized that would otherwise be disposed of after items contained therein are removed.

Figure 6:
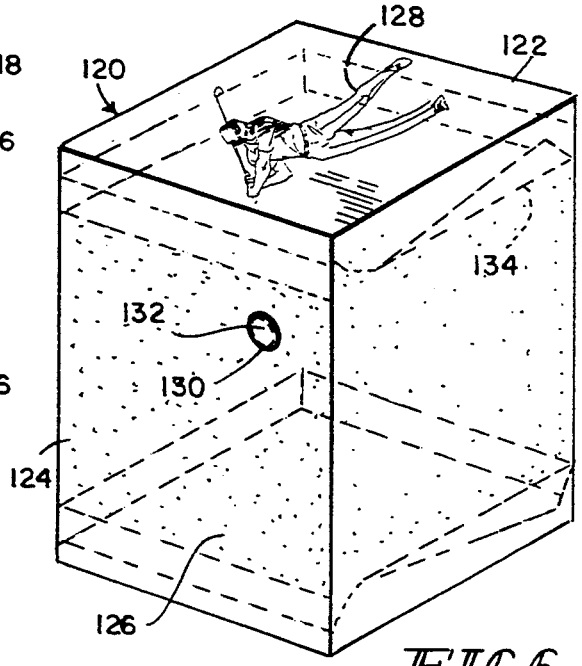
FIG. 6 is a perspective view of another embodiment of a box for containing and interacting with the sports doll of FIG. 1.

Another embodiment of a box or container 120, also for containing and interacting with doll 10 and sporting equipment 92 is shown in FIG. 6. Box 120 has a top 122, four sides 124, and a bottom 126. Box 120 may also be constructed from cardboard, paper, plastic or other equivalent material. Box 120 houses doll 10 during transport and storage. Uniform 60 and sporting equipment 92 may also be contained in box 120 but not necessarily so. A drawing, sketch, or print 128, in line, black and white, or color, appears on top 122 of box 120. Drawing 128 is intended to correspond to and indicate the sporting motif of doll 10, in this case golf.

Box 120 may be adapted so as to create a playing environment for interacting with doll 10 and sporting equipment 98. A hole may be formed in side 124 of box 120. Adapting structure such as perforations 130 may be utilized to aid in the removal of circular piece 132 to form the hole. Additional perforations 134 aid in adopting box 120 to form a putting green for interacting with doll 10, in this case a golfer doll, and sporting equipment 92, such as a golf putter and golf ball. The adaptability of box 120 also is environmentally conscious in that material is used that would otherwise be disposed of after items contained in the box are removed.

While boxes 100 and 120 for baseball and golf sporting dolls are shown in FIGS. 5 and 6, other boxes for other types of sporting dolls are within the scope and spirit of the present invention. For example, a box for a basketball sports doll with a basketball could be converted into a basketball hoop and/or basketball court.

Doll 10, uniform 60, sporting equipment 92, and box 100 or 120 may be sold as a kit for creating a sporting environment for a particular sport. For example, container 120 could be modified so as to create a putting green for interacting with a "golfer" doll. A "golfer" doll may have a golf outfit, a putter, and a golf ball. The "golfer" doll could have hook material 78 on the palms 76 thereof for releasable attachment to the putter having loop material 80 on a portion thereof.

The previously described embodiments of the invention have many advantages, some of which include that engaging structure 20 can be disabled and protected by covering structure 86 when not in use. By covering hook portion 78 when not in use, it will reduce exposure to engaging structure 20 and reduce the amount of debris that collects on its surface and inhibits its operation.

Another advantage of the invention is that the box in which doll 10 is contained during transport can be modified so as to create an environment for interacting with doll 10. This is environmentally beneficial because at least a portion of the box can be used for another purpose after transport rather than being thrown away.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A doll comprising a body, a removable item sized to be attached temporarily to the body and including an attachment portion, means on the body for releasably engaging the attachment portion so that the removable item is attached to the body until it is removed by a person handling the doll, and means tethered to the body for covering the engaging means to block engagement of the attachment portion and the engaging means so that the engaging means is disabled until it is desired to attach the removable item to the engaging means.

2. The doll of claim 1, wherein the engaging means includes hook material and each of the attachment portion and the covering means includes loop material.

3. The doll of claim 1, further including a strip having a front surface and a back surface, wherein the engaging means and covering means are on the front surface of the strip.

4. The doll of claim 3, further including means for connecting the strip to the body of the doll so that the covering means on the strip is movable to cover the engaging means and expose a portion of the back surface of the strip.

5. The doll of claim 4, wherein at least the exposed portion of the back surface of the strip is smooth in texture.

6. The doll of claim 1, further including a uniform for the doll corresponding to a particular sport and wherein the item is a piece of sporting equipment proportionately sized relative to the doll and corresponding to the sport of the uniform.

7. A doll comprising a body, an item of sporting equipment, means for temporarily attaching the item of sporting equipment to the body the attaching means including a first patch on the body and a second patch on the item of sporting equipment, and means tethered to the body for covering the first patch upon disengagement of the first and second patches once the item of sporting equipment is detached from the body.

8. The doll of claim 7, wherein the first patch includes hook material and the second patch includes loop means for engaging the hook material.

9. The doll of claim 7, wherein the covering means includes a strip having one end that carries the first patch connected to the body and another end carrying a third patch.

10. The doll of claim 9, wherein the first patch includes hook material and the third patch includes loop means for engaging the hook material.

11. The doll of claim 7, wherein the covering means includes a third patch and means for carrying the third patch between an engaged position contacting the first patch and a disengaged position away from the first patch.

12. The doll of claim 11, wherein the first patch includes hook material and the third patch includes loop means for engaging the hook material of the first patch.

13. A kit for creating a sporting environment the kit comprising a doll, at least one piece of sporting equipment proportionally sized relative to said doll means on the sporting equipment for releasably attaching the sporting equipment to said doll, means on the doll for engaging the attaching means, means tethered to the doll for covering the engaging means, a box for containing the doll and the sporting equipment, and means formed in the box for adapting the box so as to create a playing environment for interacting with the doll and the sporting equipment.

14. The doll of claim 13, wherein the engaging means includes hook material and each of the attaching means and covering means includes loop material.

15. The doll of claim 13, further including a strip having a front surface and a back surface, wherein the engaging means and covering means are on the front surface of the strip.

16. The doll of claim 15, further including means for connecting the strip to the doll so that the covering means on the strip is movable to cover the engaging means and expose a portion of the back surface of the strip.

17. The doll of claim 16, wherein at least the exposed portion of the back surface of the strip is smooth in texture.

18. The kit of claim 13, further comprising a uniform for the doll corresponding to the sport represented by the sporting equipment.

19. The kit of claim 13, wherein the adapting means includes a perforated pattern on at least one surface of the box.

20. A doll comprising a body, a removable item sized to be attached temporarily to the body and including an attachment portion, means on the body for releasably engaging the attachment portion so that the removable item is attached to the body until it is removed by a person handling the doll, means for covering the engaging means to block engagement of the attachment portion and the engaging means so that the engaging means is disabled until it is desired to attach the removable item to the engaging means, a strip having a front surface and a back surface, wherein the engaging means and covering means are on the front surface of the strip, and means for connecting the strip to the body of the doll so that the covering means on the strip is movable to cover the engaging means and expose a portion of the back surface of the strip.

21. The doll of claim 20, wherein at least the exposed portion of the back surface of the strip is smooth in texture.

22. A doll comprising a body, an item of sporting equipment, means for temporarily attaching the item of sporting equipment to the body, the attaching means including a first patch on the body and a second patch on the item of sporting equipment, and means for covering the first patch upon disengagement of the first and second patches once the item of sporting equipment is detached from the body, wherein the covering means includes a strip having one end that carries the first patch connected to the body and another end carrying a third patch.

23. The doll of claim 22, wherein the first patch includes hook material and the third patch includes loop means for engaging the hook material.

24. A kit for creating a sporting environment the kit comprising a doll, at least one piece of sporting equipment proportionally sized relative to said doll means on the sporting equipment for releasably attaching the sporting equipment to said doll, means on the doll for engaging the attaching means, means for covering the engaging means, a box for containing the doll and the sporting equipment, means for adapting the box so as to create a playing environment for interacting with the doll and the sporting equipment, a strip having a front surface and a back surface, wherein the engaging means and covering means are on the front surface of the strip, and means for connecting the strip to the doll so that the covering means on the strip is movable to cover the engaging means and expose a portion of the back surface of the strip.

25. The doll of claim 24, wherein at least the exposed portion of the back surface of the strip is smooth in texture.

* * * * *